United States Patent [19]

Geortner

[11] Patent Number: 4,622,794

[45] Date of Patent: Nov. 18, 1986

[54] PANEL WALL SYSTEM

[75] Inventor: Jack Geortner, Chatham, N.J.

[73] Assignee: Construction Specialties, Inc., Cranford, N.J.

[21] Appl. No.: 458,540

[22] Filed: Jan. 17, 1983

[51] Int. Cl.[4] ..... E04B 1/62

[52] U.S. Cl. ..... 52/403; 52/476; 52/772; 52/780; 52/391; 52/235

[58] Field of Search ..... 52/476, 762, 768, 772, 52/774, 775, 282, 36, 509, 489, 512, 513, 391, 403, 489, 36

[56] References Cited

U.S. PATENT DOCUMENTS

| | | | |
|---|---|---|---|
| 2,171,221 | 8/1939 | Maus | 52/474 |
| 2,251,991 | 8/1941 | Fellner | 52/489 |
| 2,735,523 | 4/1952 | Leyerle et al. | 52/391 X |
| 3,008,249 | 11/1961 | Masters . | |
| 3,550,337 | 12/1970 | Lorenz | 52/235 X |
| 4,009,549 | 3/1977 | Hala | 52/235 X |
| 4,070,835 | 1/1978 | Reverend et al. | 52/235 |
| 4,163,350 | 8/1979 | Doguchi et al. | 52/772 X |
| 4,370,841 | 2/1983 | Hayashi | 52/780 X |
| 4,506,484 | 3/1985 | Bartlett et al. | 52/476 |

FOREIGN PATENT DOCUMENTS

| | | | |
|---|---|---|---|
| 2139623 | 2/1973 | Fed. Rep. of Germany | 52/772 |

*Primary Examiner*—William F. Pate, III
*Assistant Examiner*—Creighton Smith
*Attorney, Agent, or Firm*—Brumbaugh, Graves, Donohue & Raymond

[57] ABSTRACT

A panel wall assembly comprises rectangular panlike panels mounted close together side by side and end to end. Retainers located at all junctures between the panels are fastened to the building structure, and the panels are fastened to the retainers by clips having arms that extend out through slots in the panel flanges and clamp the edges of the flanges against seating surfaces on the retainers.

9 Claims, 3 Drawing Figures

PANEL WALL SYSTEM

FIELD OF THE INVENTION

The present invention relates to a panel wall system and, in particular, a wall cladding system that is especially suitable for use in commercial and industrial buildings.

BACKGROUND OF THE INVENTION

There are, of course, many ways of finishing the exteriors of commercial and industrial buildings. One type of external wall system utilizes individual prefabricated panels that are suitably fastened to the building framing, ordinarily by a relatively light-weight retaining system to which the panels can readily be attached and by which the panels are joined to the main building framing. Within this general type of exterior panel wall system are some commercially available versions that utilize composite panels composed of thin aluminum sheets laminated to a plastic core. These composite panels fit into a frame work made up of retainers having grooves that receive the edges of the panels.

These previously known panel systems based on aluminum/plastic/aluminum composite panels have several disadvantages. For one thing the framing system ordinarily requires that the panels and retainers be installed in step, panel by panel and retainer by retainer, working horizontally and vertically, inasmuch as the system depends upon reception of the panel edges in channels or tracks of the retainers. Thus, after a panel is installed the retainer track for the then free edges of the panel are installed and so forth. As far as installation costs are concerned, the assembly procedure is relatively inexpensive and can be accomplished relatively quickly. On the other hand, there is a distinct disadvantage that any panels that might be damaged during the life of the building are difficult to replace. Moreover, the composite panels have shown a tendency to delaminate because of deterioration of the adhesives due to the effect of moisture that attacks the edges where they fit into the retainers.

SUMMARY OF THE INVENTION

There is provided, in accordance with the present invention, an exterior panel wall system that comprises rectangular panels arranged close together side by side and end to end. The panels are joined to the main framing of the building by retainers, a vertical retainer being located at and being coextensive with the juncture between the vertical edges of each pair of adjacent panels and a horizontal retainer being located at and being coextensive with the juncture between the horizontal edges of each pair of adjacent panels. Each retainer is suitably fastened to the building structure. To the extent broadly described above the system is known in the prior art.

The present invention is characterized in that each panel is of pan-like shape in that it includes a principal wall forming a portion of the exterior building wall and a continuous peripheral flange extending inwardly toward the interior of the building from the principal wall and lying perpendicular to the principal wall. Each retainer includes a medial portion received between the flanges of the panels on either side of it and a lateral flange extending out on either side of the medial portion that provides a seating surface for the edge of the flange of the corresponding panel. The flange on each edge of each panel is fastened to the adjacent retainer by attachment clips that are connected to the medial portion of the retainer by screws and have arms that extend through slots in the panel flange.

In a preferred embodiment the slots in the adjacent flanges of each pair of adjacent panels are located opposite each other and each attachment clip has an arm at each end that extends into the corresponding slot. Hence, each clip joins the adjacent flanges of adjacent panels to the retainer between them.

Preferred embodiments of the invention also incorporate the following features:

(1) Each slot in each panel is elongated in a direction substantially parallel to the edge of the panel flange and is of a length such that the attachment clip can be rotated into and out of the slot for installation and removal, thereby enabling the retainers to be installed as one phase of the construction and permitting the panels to be installed at a later phase. More importantly, this feature makes it possible for damaged panels to be removed individually and replaced by a new panel.

(2) The vertical and horizontal retainers are of uniform cross-sections along their lengths, and both vertical and horizontal retainers are of the same cross-section. This feature permits a reduction in tooling and manufacturing costs. The retainers are preferably made by extruding them from aluminum and cutting the extruded members to the desired lengths.

(3) The medial portion of each retainer has a key way facing towards the clips, and each clip has a key portion received in the key way to maintain the clip in the clamped position in the slot of the panel. Accordingly, the clips are automatically oriented in the desired clamped position at the time of installation and thereafter.

(4) A gasket of low friction material is interposed between each panel flange and the lateral edge of the retainer that bears against it. The gasket affords movement of the flange edge relative to each retainer in accordance with differences in the amounts of thermal expansion and contraction of the panels, retainers and the building structure. The gaskets also help seal the wall.

(5) Each vertical retainer is fastened to the building structure by a fastener that passes through an elongated slot in the retainer that is aligned with the axis of the retainer, thereby to permit differential thermal expansion of the retainer and the building structure.

(6) The medial portion of each horizontal retainer has a socket at either end, and a splice bar having a lug that extends beyond the end of the retainer is affixed within the socket. The flange portion of each vertical retainer has a channel that accepts the lug of the splice bar of the adjacent horizontal retainer with a sliding fit. The splice bar helps maintain continuity between the horizontal and vertical members while making the system easy to install.

A panel wall system constructed in accordance with the present invention has several advantages over prior art systems. It utilizes durable panels that are highly resistant to damage due to deterioration from sun, dirt, moisture, thermal cycling, fire, and other environmental conditions and hazards. The panel edges are protected from the weather by a sealant or gasket. The system provides for relative movement due to differences in thermal expansion and contraction of the panels, retainers and the building structure, respectively. In the event that a panel is damaged it can be easily removed and replaced. The system is architecturally distinctive in that it is based on relatively massive panels separated only by very thin lines and entirely free of any visible framing or other supporting elements.

For a better understanding of the invention reference may be made to the following description of an exemplary embodiment, taken in conjunction with the figures of the accompanying drawings.

DESCRIPTION OF AN EXEMPLARY EMBODIMENT

Figure 1:
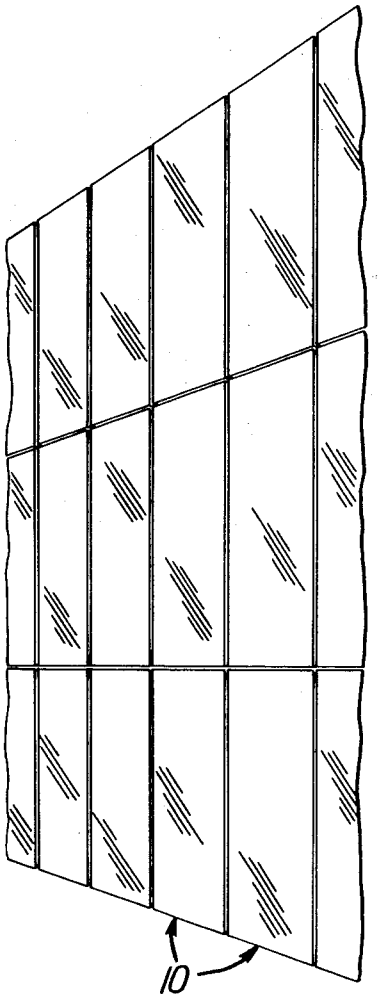
FIG. 1 is a perspective view from in front and to one side of a section of a building wall formed from the system according to the present invention.

The present invention is a panel wall cladding system based on a multiplicity of rectangular panels 10 arranged in closely spaced relation side by side and end to end. In the embodiment shown in FIG. 1, the panels are all of the same size and are arranged with the adjacent corners of each cluster of four panels meeting at a common point. This is the preferred arrangement for aesthetic and structural reasons, but it is also possible to stagger the panels in other arrangements. Ordinarily, the panels should be aligned vertically for structural reasons, but the positions of individual panels in adjacent vertical rows can be varied. Moreover, the system can employ panels of different sizes. Panels located at a corner of the building can extend around the corner and may have rounded or sharp corners.

Figure 2:
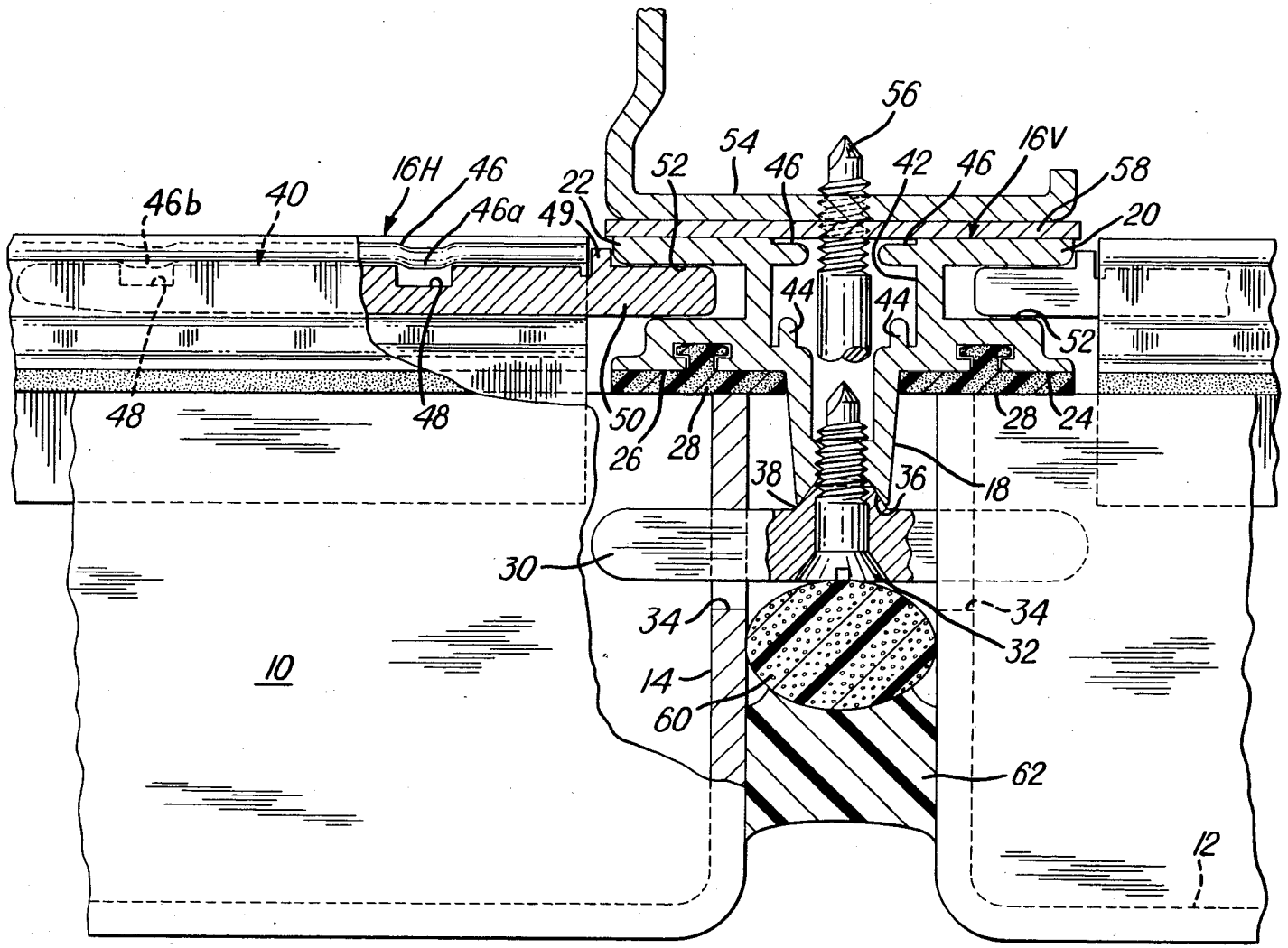
FIG. 2 is a top view of a pair of side by side panels, portions of the components being broken out in cross section.
Figure 3:
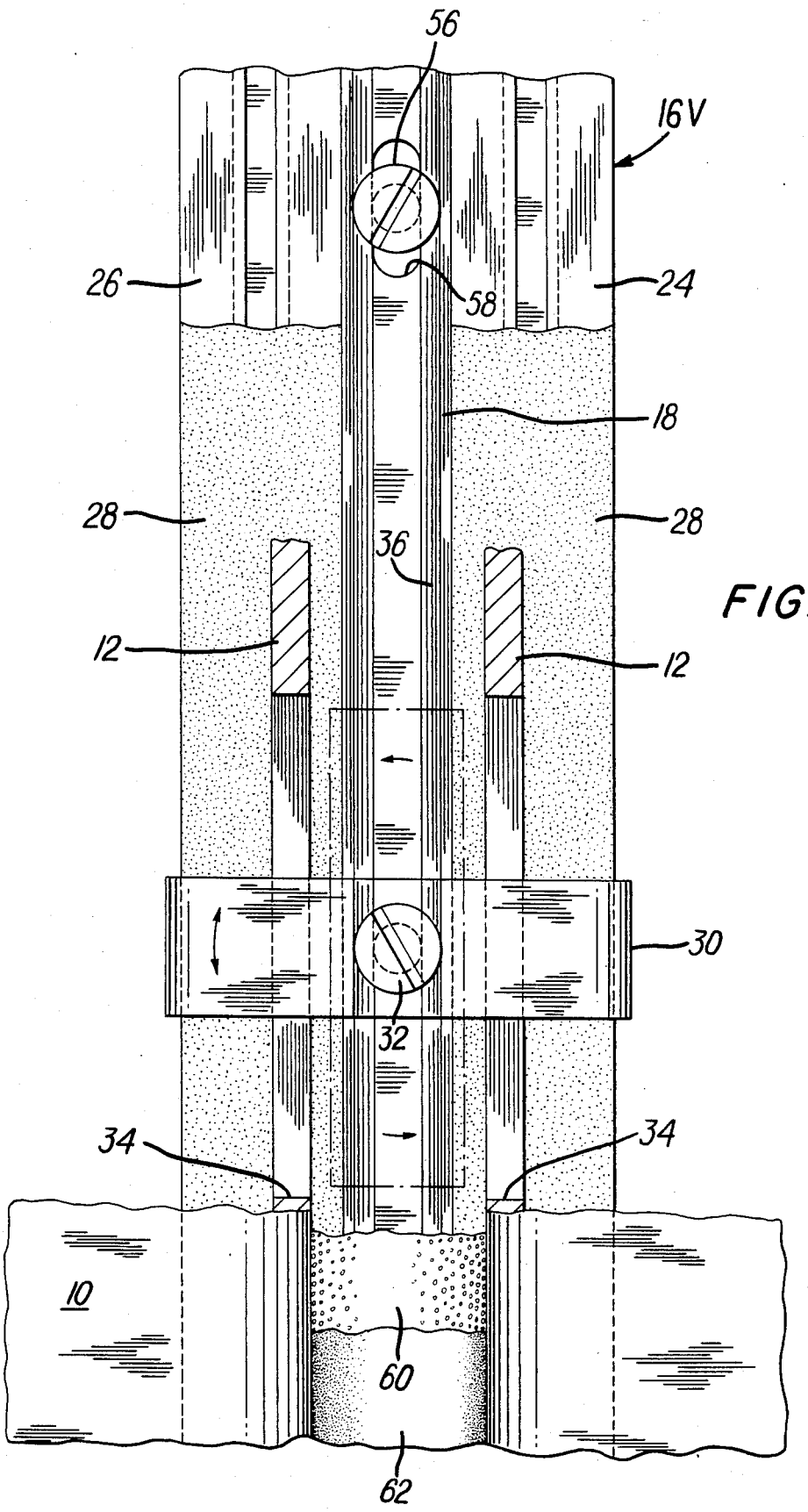
FIG. 3 is a front view of a pair of adjacent portions of a pair of side by side panels, portions being successively broken away into cross-sections moving from the bottom toward the top.

Referring to FIGS. 2 and 3 of the drawings, each panel 10 is generally pan-shaped in that it is composed of a principal wall portion 12 that forms the exterior wall surface and an inturned peripheral flange 14 that is of uniform width, extends entirely around the perimeter of the panel and lies perpendicular to the principal wall portion 12. Preferably, each panel 10 is made from aluminum sheet 0.120 inch in thickness break-formed so that the flanges are integral with the principal wall. Square segments are cut from each corner of the panel before it is break-formed and the edges of the vertical and horizontal segments of the peripheral flange are joined at the corners by welding. The welds are ground and polished to provide smooth and rounded edges for good appearance. The panels are treated for corrosion resistance and may be finished with any suitable quality architectural finishes, such as anodic coatings or fluorocarbon paints.

The panels may range in size from about $2' \times 2'$ to about $5' \times 12'$. Stiffeners should be added in the crosswise direction in large size panels. The stiffeners may, for example, be one $1'' \times 1\frac{1}{2}'' \times 1''$ channels bonded by an epoxy adhesive to the principal wall and welded to the flanges.

It is within the scope of the present invention to form the panels from materials other than aluminum sheet. For example, the panels may be aluminum-polymeric foam-aluminum sandwiches, molded fiberglass or vacuum-formed vinyl-acrylic. Soldering, brazing or adhesive—joining can be substituted for welding. Lighter gage panels can be used in interior applications. Special panel shapes will be provided at corners and for copings, soffits and other architectural details.

The panels are joined to the building by a system of retainers 16, there being a vertical retainer 16V located at the vertical juncture between each pair of side by side panels and a horizontal retainer 16H located at the juncture between each pair of vertically adjacent panels. Both the vertical and horizontal retainers are of the same cross-section and are of uniform cross-sections along their lengths.

The retainers 16 are generally T-shaped in cross-section. They consist of a medial portion 18 and a pair of lateral flanges 20 and 22 that extend out on either side of the medial portion. The front faces 24 and 26 of the flanges 20 and 22 constitute seating surfaces for the edges of the panel flanges. A longitudinally continuous gasket 28 of a low friction material, such as 80 durometer PVC, is received on the front face of each flange 20 and 22 and facilitates movement of the edges of the panel flanges toward and away from the medial flange 18, due to differential thermal expansion and contraction.

The panels are clamped to the adjacent retainers along all four sides by attachment clips 30 that are fastened to the medial portion 18 of the retainer by self-drilling/self-tapping screws 32. Each clip 30 has arms extending outwardly in either direction from the medial portion of the retainer and out through slots 34 in the flanges of the panels. Depending upon the size of the panel and other design considerations, the spacing of the clips may range from about 12" to 24" along each flange. A groove 36 extends along the entire length of the medial portion of the retainer, the side walls of the groove 36 being tapered in correspondence with the taper of flat head screws. Each clip has a rib 38 having tapered walls that match the taper of the groove 36. The groove 36 serves as a key-way for all of the clips, and the rib 38 serves as a key that ensures proper positioning of the clips with their lengthwise axes lying perpendicular to the lengthwise axis of the retainer.

The width of each slot 34 in the flanges of the panels is slightly greater than the overall thickness of the clip (the thickness being considered as the dimension perpendicular to the principal faces of the panels) so that each clip can be initially oriented perpendicular to its installed position, slipped in between adjacent panels rotated to the installed position and fastened to the retainer. To this end, the slots 34 are also elongated in a direction parallel to the edge of the panel (see FIG. 3) to permit the clips to be rotated into and out of the slots.

Each horizontal retainer 16H is joined at each end to the adjacent vertical retainers 16V by a splice bar 40 that is received in a socket 42 formed in the medial portion of the retainer in between the two flanges 20 and 22. Portions of outer face of each splice bar bear against a pair of ribs 44, and the edge portions of the inner face bear against ribs 46. The splice bar is retained in place in each horizontal retainer 16H by deforming portions **46*a* and 46*b* of the ribs 46 into notches 48 in the inner face of the splice bar. A stop shoulder 49 of the splice bar establishes the installed position by bearing against the end of the horizontal retainer 16H. A lug 50 extends out beyond the end of the horizontal retainer, and is received with a sliding fit in a longitudinally continuous channel 52 formed in each retainer flange portion 20 and 22, thus to provide the splice connection between the horizontal and vertical retainers. The horizontal retainers 16H** may be fastened to the building structure by screws, but in many cases the horizontal retainers will not be fastened, thereby allowing them to move in accordance with thermal expansion and contraction. This will generally be the case when the vertical dimension of the panels is large and the horizontal dimension small.

Each vertical retainer is fastened at suitable intervals to the building structure by a suitable fastening system. In the embodiment shown in the drawing, the structure of the building itself includes steel studs 54 welded or otherwise fastened between the main frame beams or other elements at the perimeter. Each vertical retainer is fastened to the steel studs 54 by self-drilling/self-tapping screws 56 that pass through elongated slots 58 in the medial portion 18 of the retainer, through shims 59 (if required) and through the outer flange of the stud 54. The elongated slots 58 allow for the difference between the thermal expansion of the aluminum retainer and the thermal expansion of the building structure. Flanges can be added to each edge at the back of the retainer to enable fastening the retainer to a block, concrete or other solid building wall.

After installation of the panel system backer rods 60 of a moderately compressible polymeric foam are installed at all joints between the panels, and the joints are sealed and finished with a suitable elastomeric sealant 62. The sealant not only seals the wall but protects the panel edges from moisture, an important advantage in the case of composite panels. Moderately compressible neoprene or EPDM rubber gaskets or other suitable dry joint systems can be substituted for the backer rods and sealant.

I claim:

1. An exterior panel wall assembly having a multiplicity of rectangular panels arranged in closely spaced relation side by side and end to end and retainers fastened to the building structure and interposed between the building structure and a pair of edges of a pair of adjacent panels characterized in that each panel is of panlike shape, having a principal wall forming a portion of an exterior building wall and a continuous peripheral flange extending toward the building structure, in that each retainer includes a medial portion received between the flanges of the panels on either side of it and a lateral flange extending out on either side of the medial portion that provides a seating surface for the edge of the flange of the corresponding panel, in that the panel flange includes at least one slot located closely adjacent and outwardly of the medial portion of each adjacent retainer, and in that the slotted flange is fastened to the corresponding retainer by at least one attachment clip that is rotatably connected to the medial portion of the retainer and that has an arm that is adjustable from a position intermediate adjacent flanges of a pair of panels to a position which extends through the slot in the adjacent panel flange.

2. An assembly according to claim 1 and further characterized in that there are slots in the adjacent flanges of said pair of adjacent panels located opposite each other and in that each attachment clip has an arm at each end that extends into the corresponding slot, whereby each clip joins the adjacent flanges of adjacent panels to the retainer between them.

3. An assembly according to claim 1 and further characterized in that each slot is elongated and is of a length such that the attachment clip can be rotated into and out of the slot for installation and removal of the panel, the clip being of a width less than the spacing between the adjacent panels.

4. An assembly according to claim 1 and further characterized in that there are vertical and horizontal retainers of uniform cross-sections along their lengths and of the same cross-section and in that there are vertical retainers located at and coextensive with the juncture between the vertical edges of pairs of adjacent panels and horizontal retainers located at and coextensive with the juncture between the horizontal edges of pairs of adjacent panels.

5. An assembly according to claim 4 and further characterized in that the medial portion of each retainer has a key-way facing toward the clips, and each clip has a key portion received in the key-way to maintain the clip in the clamped position in the slot of the panel.

6. An assembly according to claim 1 and further characterized in that a gasket of low friction material is interposed between each panel flange and the lateral flange of the retainer that bears against it, the gasket affording movement of the flange edge in accordance with differences in the thermal expansions and contractions of the panels, retainers and the building structure.

7. An assembly according to claim 4 and further characterized in that each vertical retainer is fastened to the building structure by a fastener that passes through an elongated slot in the retainer, thereby to permit differential thermal expansion of the retainer and the building structure.

8. An assembly according to claim 4 and further characterized in that the medial portion of each horizontal retainer has a socket at either end, in that a splice bar having a lug extending beyond the end of the retainer is affixed within each socket, and in that the flange portion of each vertical retainer has a channel that accepts the lug on the splice bar of the adjacent horizontal retainer, the fit between the lug and the channel being a sliding fit to allow for thermal expansion and contraction.

9. An assembly according to claim 1 and further comprising compressible sealing means at each juncture between adjacent panels.

* * * * *